US007572103B2

(12) United States Patent
Walters et al.

(10) Patent No.: US 7,572,103 B2
(45) Date of Patent: Aug. 11, 2009

(54) COMPONENT COMPRISING A MULTIPLICITY OF COOLING PASSAGES

(75) Inventors: Sean A Walters, Bristol (GB); Daniel P Moss, Dorchester (GB); Mark T Mitchell, Bristol (GB)

(73) Assignee: Rolls-Royce plc, London (GB)

( * ) Notice: Subject to any disclaimer, the term of this patent is extended or adjusted under 35 U.S.C. 154(b) by 385 days.

(21) Appl. No.: 11/490,087

(22) Filed: Jul. 21, 2006

(65) Prior Publication Data

US 2007/0031252 A1 Feb. 8, 2007

(30) Foreign Application Priority Data

Aug. 2, 2005 (GB) ..... 0515861.3

(51) Int. Cl.
*F01D 5/18* (2006.01)

(52) U.S. Cl. ..... 416/96 R; 416/97 R

(58) Field of Classification Search ..... 415/115; 416/96 R, 97 R, 92
See application file for complete search history.

(56) References Cited

U.S. PATENT DOCUMENTS 3,264,825 A 8/1966 Halls et al.
3,688,833 A 9/1972 Bykov et al.
3,819,295 A 6/1974 Hauser et al.
5,326,224 A * 7/1994 Lee et al. ..... 416/97 R
5,660,523 A * 8/1997 Lee ..... 416/97 R
5,690,472 A * 11/1997 Lee ..... 416/97 R
7,021,896 B2 * 4/2006 Dodd ..... 416/97 R
2004/0151586 A1 8/2004 Chlus et al.

FOREIGN PATENT DOCUMENTS

EP 1-091-091 A2 4/2001
EP 1 091 092 A2 4/2001
GB 1 257 041 12/1971
GB 2-310-896 A 9/1997
GB 2-401-915 A 11/2004

* cited by examiner

*Primary Examiner*—Ninh H Nguyen
(74) *Attorney, Agent, or Firm*—Oliff & Berridge, PLC

(57) ABSTRACT

A component comprises a multiplicity of cooling passages arranged in two intersecting arrays to form a multiplicity of cooling passage intersections. Air jet interactions are generated at cooling passage intersections when air is passed through the cooling passages. The spacing of the passages in at least one of the arrays is chosen to provide a predetermined range of intersection density in a selected region or regions of the component.

14 Claims, 3 Drawing Sheets

COMPONENT COMPRISING A MULTIPLICITY OF COOLING PASSAGES

The invention relates to a component comprising a multiplicity of cooling passages.

In particular it relates to a component comprising a multiplicity of cooling passages which are arranged in two intersecting arrays to form a multiplicity of cooling passage intersections.

It is known to duct cooling fluid through cooling passages in components to transfer heat from the component to the cooling fluid and hence provide cooling. It is also known that cooling passage intersections enhance cooling by providing locations at which cooling fluid interacts. Air jet interactions disturb the boundary layer formed in the cooling passages thereby increasing the heat transfer rate between the component and the cooling fluid.

Conventionally cooling passages are provided in lattice type arrangements, for example as shown in Rolls-Royce's Patent GB 1257041 and General Electric Patent U.S. Pat. No. 3,819,295. In both cases the lattice is formed by evenly spaced intersecting arrays of parallel cooling passages. The disadvantage of such cooling lattices is that the cooling effect is uniform throughout the lattice and hence flow rate of cooling fluid is not optimised for greatest cooling efficiency. In components where there is a limited cooling fluid supply, for example in a turbine aerofoil of a gas turbine engine, it is desirable to use cooling fluid efficiently. If not all parts of the component require the same amount of cooling because, for example, not all parts of the component are at the same temperature when operational, then providing the same amount of cooling fluid to all regions of the cooling lattice will result in an inefficient use of fluid which will result in over-cooling in some regions. Since the lattice pattern is uniform and there is only a finite flow rate of cooling fluid, it may also be the case that some regions are undercooled because air has been delivered unnecessarily to other regions in the component. It will be appreciated that in a component such as a turbine aerofoil for a gas turbine engine, the cooling fluid supplied is provided to the detriment of engine cycle efficiency.

Therefore a component comprising cooling passages arranged in a way to provide optimal cooling whilst using cooling fluid efficiently, and hence minimising the amount of fluid used for cooling, is highly desirable.

According to the present invention there is provided a component comprising a multiplicity of cooling passages arranged in two intersecting arrays to form a multiplicity of cooling passage intersections, such that when air is passed through said cooling passages, air jet interactions are generated at said cooling passage intersections wherein the spacing of the passages in at least one of the arrays is chosen to provide a predetermined range of intersection density in a selected region or regions of the component.

The present invention is a component provided with intersecting cooling passages arranged such that in regions where there is a high density of intersections a high degree of cooling is achieved and in regions where there are a low density of intersections a lower degree of cooling is achieved. That is to say, in regions where it is likely the component will require a large amount of cooling the cooling passages are closely spaced and a larger number of intersections are provided and in regions where the component will require relatively less cooling the cooling passages are spaced apart by a larger amount and a smaller number of intersections are provided. In operation air jet interactions at the numerous intersections will enhance convective heat transfer.

The advantage of such an arrangement is that if there are regions of the component which require less cooling than other regions, the cooling fluid can be used more efficiently because it can be concentrated in the regions which require more cooling.

Alternatively the cooling arrangement can be employed to reduce the total amount of cooling fluid required to feed the component since such a configuration demands less cooling flow in regions where relatively little cooling is required.

The pursuit of more efficient aerofoil cooling systems in gas turbine engines is a critical area of research and development. More efficient systems increase the mechanical life of components and improve engine performance.

Preferably at least one of the arrays is fan shaped. That is to say the cooling passages in at least one region of the component are at an angle to one another such that they diverge away from one another. To put it another way, the array comprises non parallel cooling passages. The advantage of such a pattern is that it enables a greater variation in intersection density to be formed in different regions of the component, which have different cooling requirements.

Preferably the pitch of at least one of the arrays is constant. That is to say that the distance between at least some successive cooling passages is the same. Such a configuration allows for a high density of cooling passage intersections to be provided in the component where there is a high cooling requirement.

Preferably arrays are also provided in which the pitch is not constant. That is to say the distance between successive cooling passages is not the same. This allows for different regions of the component to have different intersection densities. The different pitch and angle of the passages will ensure the level of heat transfer achieved corresponds to the component's varying operational running temperature to provide the most efficient use of coolant.

For a better understanding of the present invention and to show more clearly how it may be carried into effect, reference will now be made, by way of example, to the accompanying drawings, in which.

Figure 1:
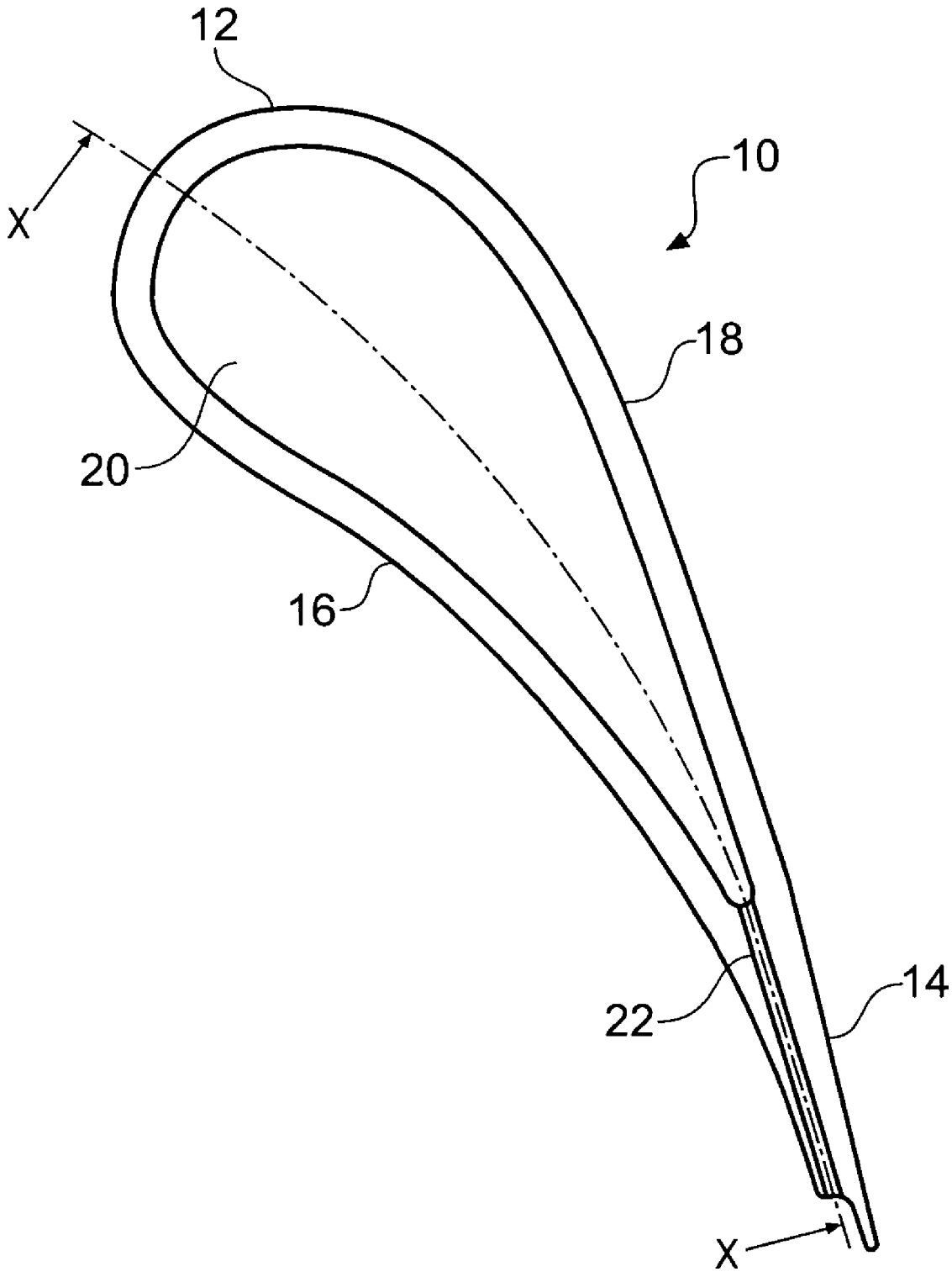
FIG. 1 shows a cross-sectional plan view of component (in this example, a gas turbine engine turbine aerofoil) according to the present invention.

Gas turbine engines contain turbine assemblies which comprise annular arrays of aerofoil components, namely stator vanes and rotor blades. Shown in FIG. 1 is a cross-sectional plan view of a component, according to the present invention. The embodiment shown is a turbine aerofoil 10 for a gas turbine engine comprising a leading edge portion 12 and a trailing edge portion 14 joined by side walls 16,18, thereby forming a chamber 20 for the delivery of cooling fluid to the component. Cooling passages 22 extend from the chamber 20 through the trailing edge portion 14 to the exterior of the turbine aerofoil 10.

Figure 2:
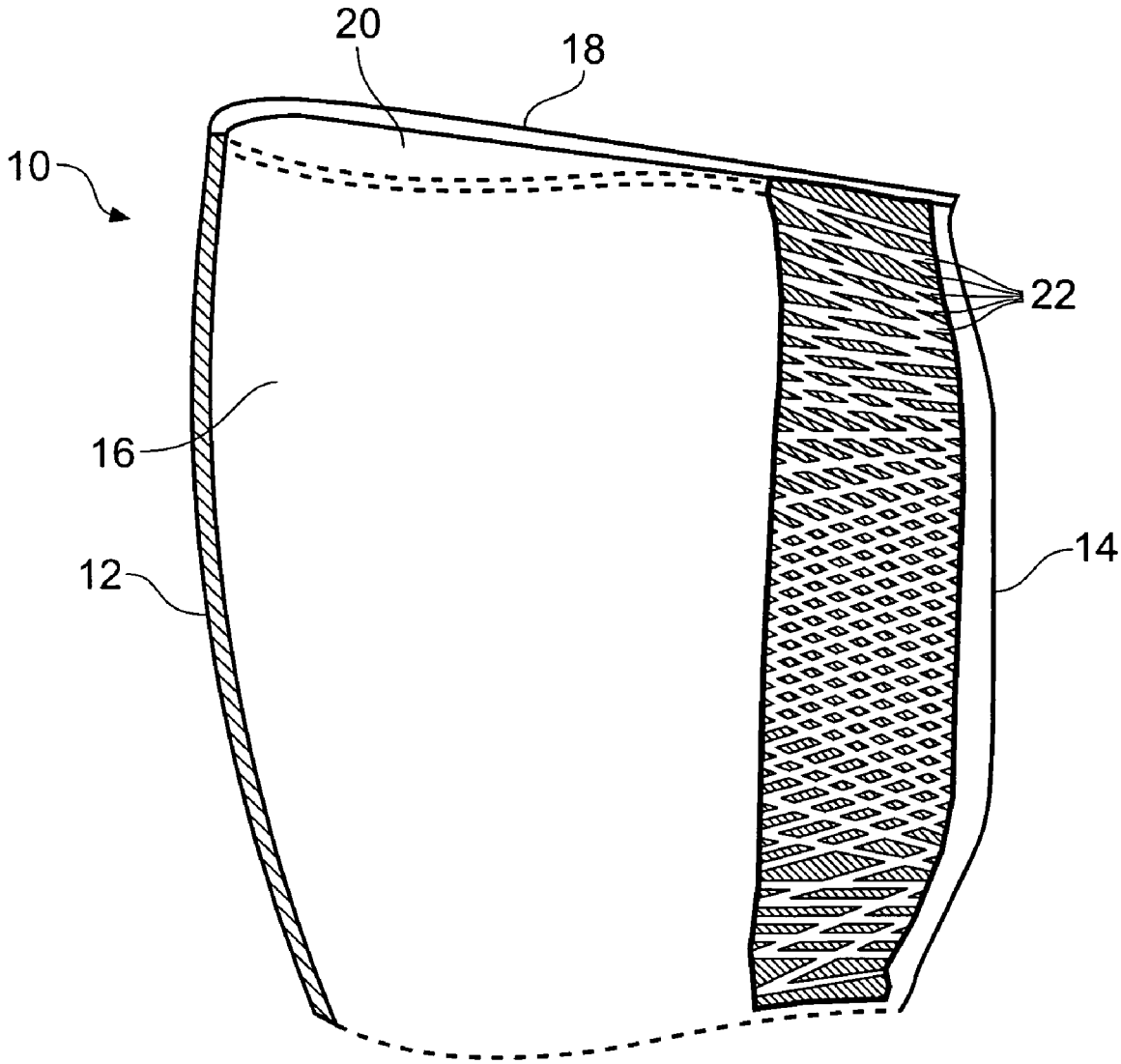
FIG. 2 shows a part cross-sectional view as taken through line X-X in FIG. 1, with the remainder of the component shown as a dotted line.

Shown in FIG. 2 is a cross-sectional view of the blade 10 taken at line X-X in FIG. 1. For clarity the cross-section has been shown as a perspective view with the side wall 16 shown as a dotted line. An example of an arrangement of intersecting cooling passages 22 is shown in the trailing edge portion 14.

Figure 3:
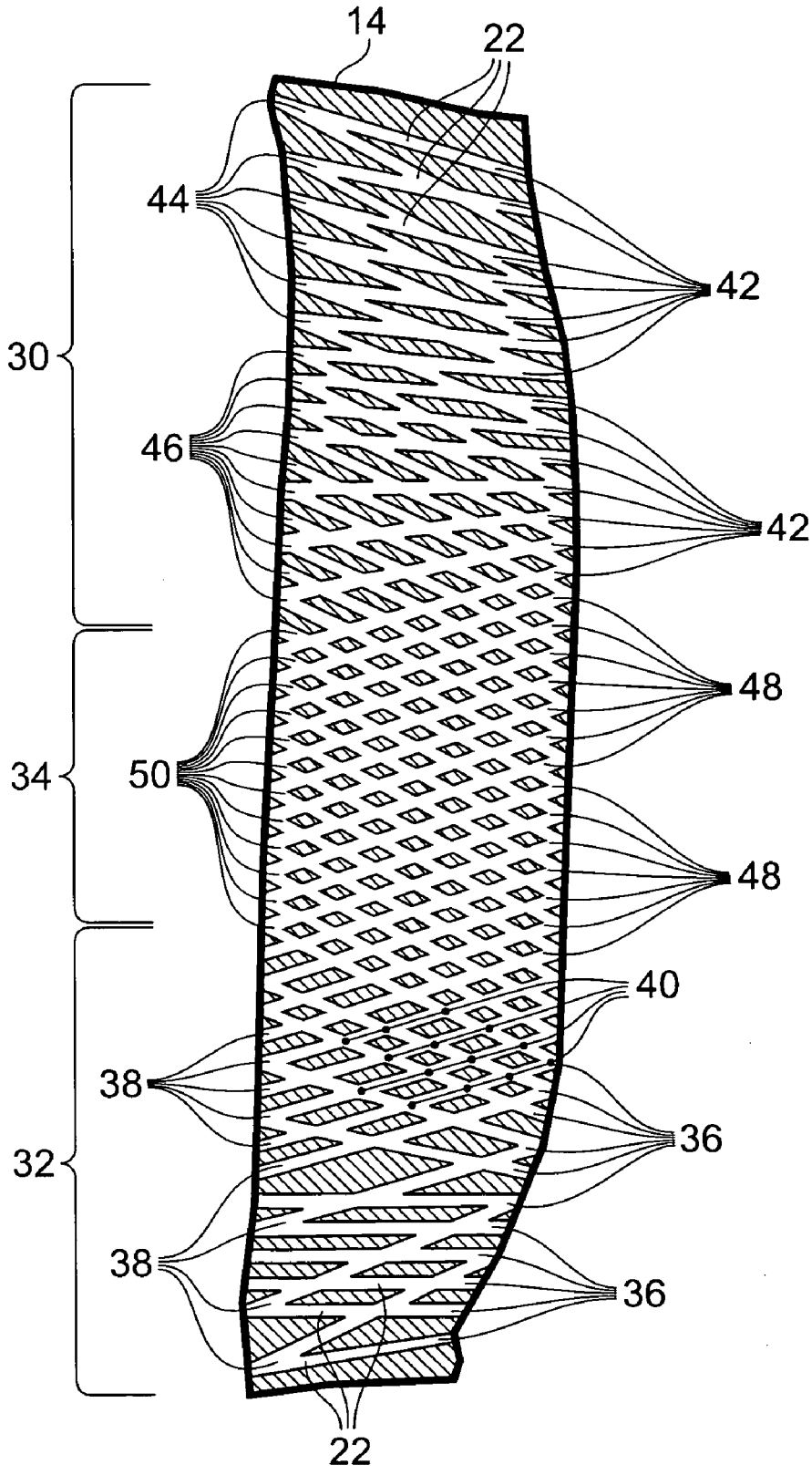
FIG. 3 shows an enlarged view of cooling passages in the trailing edge of the turbine aerofoil of FIGS. 1 and 2.

FIG. 3 shows an enlarged view of the cooling passages 22 in the trailing edge portion 14. In this embodiment of the present invention a cooling arrangement is provided in the trailing edge portion 14 and comprises a multiplicity of substantially straight and substantially co-planar cooling passages 22. In this embodiment the cooling arrangement is made up of three distinct regions, namely a radially outer region 30, a radially inner region 32 and a central region 34. The end regions 30,32 are adjacent upper and lower end walls (not shown) of the turbine aerofoil, whereas the central region 34 is mid-span.

In each region 30,32,34 the cooling passages 22 are provided in arrays. The radially inner region 32 comprises a first array 36 and a second array 38. None of the passages 22 of the first array 36 intersect one another and none of the passages 22 of the second array 38 intersect one another. The two arrays 36,38 intersect one another to form a multiplicity of cooling passage intersections 40, a small sample of which are indicated by dots "." in FIG. 3. The cooling passages 22 of both the first cooling array 36 and the second cooling array 38 are fan shaped. That is to say, the cooling passages 22 are not parallel. Put another way, moving from left to right in FIG. 3 the cooling passages 22 of the first array 36 converge, as do the cooling passages of the second array 38. Additionally the spacing between adjacent cooling passages 22 of each array 36,38 varies. That is to say, the pitch of the cooling passages 22 is not constant in the end region 32. As can be seen this results in the end region 30 having a relatively low density of cooling passages 22 and hence a relatively low density of cooling passage intersections 40.

Similarly, the radially outer region 30 comprises a third array 42, a fourth array 44 and a fifth array 46. None of the passages 22 of the third array 42 intersect one another, none of the passages 22 of the fourth array 44 intersect one another and none of the passages 22 of the fifth array 46 intersect one another. The third array 42 is intersected by the fourth and fifth arrays 44,46. Arrays 42,44 are fan shaped. That is to say, the cooling passages 22 of these arrays are not parallel. Put another way, moving from left to right in FIG. 3 the cooling passages 22 of the third array 42 converge, as do the cooling passages of the fourth array 44. The pitch of the cooling passages 22 of arrays 42,44 is slightly different to that of arrays 36,38 and hence the density of the cooling passages 22 and cooling passage intersections 40 formed by arrays 42,44 in the radially outer end region 30 gradually becomes less as the platforms of the turbine blade is approached.

The fifth array 46 comprises cooling passages 22 which are substantially parallel but have an uneven pitch. That is to say, the cooling passages 22 are not evenly spaced.

The central region 34 comprises a sixth array 48 and a seventh array 50 of which the cooling passages 22 are substantially evenly spaced and substantially parallel. None of the passages 22 of the sixth array 48 intersect one another and none of the passages 22 of the seventh array 50 intersect one another. The sixth array 48 is intersected by the seventh array 50.

Hence the trailing edge of the turbine aerofoil in this example is divided into two end regions 30,32 with a low density of cooling passage intersections 40 and a central region 34 having a relatively high density of cooling passage intersections 40.

In operation hot gas will pass over the aerofoil external surfaces, that is to say the leading edge 12, walls 16,18 and the trailing edge 14. In the embodiment shown it has been predetermined that the gas passing over the central region 34 will be hotter than that passing over the end regions 30,32. It is common practice to create a gas flow with such a temperature profile to prevent overheating of duct walls leading up to and from the end walls of the turbine aerofoil 10. It is imperative to cool the central region 34 so that temperature of the aerofoil 10 is kept below the melting point of the material it is made from, and below the maximum operational temperature to meet mechanical life requirements.

In the example described herein this is achieved when cooling air is fed from the chamber 20 through the cooling passages 22. The central region 34 will be cooled to a greater extent than the end regions 30,32. In operation air jet interactions are generated at said cooling passage intersection 40 which increase the amount of heat transfer between the cooling air and the material of the component. Hence cooling flow is optimised for greatest cooling efficiency, as the variable pitch and angle allows cooling to be matched to the expected variation in external gas temperatures over the component external surface. That is to say, different regions of the component will be cooled to different extents.

The effect on heat transfer coefficient of the present invention is significant compared with traditional trailing edge cooled systems. The increased cooling efficiency will result in improved service life as a result of lower component temperatures and increased engine cycle benefit from less coolant consumption.

The cooling passages 22 are preferably of substantially circular cross section as this is the easiest shape using machining tools such as mechanical drill bits or electro discharge machine electrodes. However in alternative embodiments it is advantageous to have cooling passages 22 of a different cross-section, for example elliptical. It is advantageous in thin walled components where a cooling passage of circular cross section would be too small to transport sufficient cooling fluid to use, for example, elliptical cooling passages, thereby optimising the surface area and volume flow rate capacity of the passages and hence enhance the heat transfer characteristics of the cooling arrangement. The advantage of the present invention is to be able to provide a predetermined density of intersections in a selected region or regions of the component. The cooling passages may be any cross-sectional shape which provide this. Additionally the cooling passages 22 may also be of different diameter. That is to say, not all of the cooling passages 22 may be of the same diameter. Such an embodiment would further enable distribution of cooling air by using a narrow cooling passage in regions requiring less cooling and a relatively large diameter cooling passage in regions requiring more cooling.

It has been shown that if the cooling passages of the two intersecting arrays intersect at an included angle of at least 10 degrees then the air jet interactions will cause sufficient turbulence to enhance the convective heat transfer between the cooling air and the material of the component.

It is advantageous to have substantially straight cooling passages 22 as these are easily produced by mechanical drilling or electro discharge machining.

While the cooling passages 22 in the example described herein are substantially coplanar, in another embodiment at least some of the cooling passages may lie in different planes. In some embodiments non planar cooling passages may help to increase the heat transfer from the component to the cooling air passing through it by ensuring that cooling passages are present in a wide volume, for example, in a thick walled or solid component.

The embodiment presented in FIGS. 2 and 3 show a specific distribution of cooling passage intersections. In a different component, for example a turbine aerofoil in a engine with a different hot gas temperature profile on the aerofoil external surface, the spacing and location of the regions of high density of intersections and relatively lower density of intersections will be predetermined and provided as appropriate to the expected external temperature profile of the component.

Additionally while the example described above specifically relates to the trailing edge of a turbine aerofoil the cooling arrangement may be provided in the leading edge 12 and/or side walls 16,18 of the turbine aerofoil 10.

The invention claimed is:

1. A component comprises a multiplicity of cooling passages arranged in two intersecting arrays to form a multiplicity of cooling passage intersections, such that when air is passed through said cooling passages, air jet interactions are generated at said cooling passage intersections wherein the spacing of the passages in at least one of the arrays is chosen to provide a predetermined range of intersection density in a selected region or regions of the component, a first array of the two intersecting arrays having passages arranged in a first pattern, and a second array having passages arranged in a second pattern different than the first pattern.

2. A component as claimed in claim 1 wherein at least one of the arrays is fan shaped.

3. A component as claimed in claim 1 wherein at least one of the arrays comprises parallel cooling passages.

4. A component as claimed in claim 1 wherein the pitch of at least one of the arrays is constant.

5. A component as claimed in claim 1 wherein the cooling passages intersect at an included angle of at least 10 degrees.

6. A component as claimed in claim 1 wherein the cooling passages are substantially straight.

7. A component as claimed in claim 1 wherein the cooling passages are substantially coplanar.

8. A component as claimed in claim 1 wherein at least one of the cooling passages has a circular cross-section.

9. A component having a cooling arrangement as claimed in claim 1 where the cooling arrangement is provided in a turbine aerofoil for a gas turbine engine.

10. A component as claimed in claim 9 wherein the cooling arrangement is provided in at least a trailing edge of the turbine aerofoil.

11. A component as claimed in claim 10 wherein the cooling arrangement is provided in at least a leading edge of the turbine aerofoil.

12. A component as claimed in claim 1, wherein the first pattern and the second pattern are substantially identical with the passages of the first array having diameters different than diameters of the passages of the second array.

13. A component as claimed in claim 1, wherein the first pattern and the second pattern are substantially identical with the passages arranged in the first pattern converging in a first direction, and the passages arranged in the second pattern diverging in the first direction.

14. A component as claimed in claim 1, wherein the passages of the first array has a different spacing from the passages of the second array.

* * * * *